US009470424B2

(12) United States Patent
Iwazaki et al.

(10) Patent No.: US 9,470,424 B2
(45) Date of Patent: Oct. 18, 2016

(54) OUTDOOR UNIT FOR AIR CONDITIONER

(71) Applicant: MITSUBISHI ELECTRIC CORPORATION, Tokyo (JP)

(72) Inventors: Hiroshi Iwazaki, Tokyo (JP); Toshiyuki Kubono, Tokyo (JP); Kazuhiro Ooishi, Tokyo (JP); Hidetaka Yamauchi, Tokyo (KR); Tomoya Yanase, Tokyo (JP); Kazuho Itou, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 153 days.

(21) Appl. No.: 14/054,988

(22) Filed: Oct. 16, 2013

(65) Prior Publication Data

US 2014/0131024 A1 May 15, 2014

(30) Foreign Application Priority Data

Nov. 15, 2012 (JP) ..... 2012-250858

(51) Int. Cl.

| | |
|---|---|
| ***F24F 3/06*** | (2006.01) |
| ***F24F 13/22*** | (2006.01) |
| ***F24F 1/06*** | (2011.01) |
| ***F24F 1/36*** | (2011.01) |

(52) U.S. Cl.

CPC . *F24F 3/06* (2013.01); *F24F 1/06* (2013.01); *F24F 1/36* (2013.01); *F24F 13/222* (2013.01)

(58) Field of Classification Search

CPC ..... F24F 1/36; F24F 3/06; F24F 1/06; F24F 13/222; F25B 47/006

USPC ..... 165/170, DIG. 195, DIG. 198

See application file for complete search history.

(56) References Cited

U.S. PATENT DOCUMENTS 4,748,827 A * 6/1988 Chang ..... 62/272
6,112,536 A * 9/2000 Hansen ..... 62/285

(Continued)

FOREIGN PATENT DOCUMENTS

CN 1548850 A 11/2004
CN 101726047 A 6/2010

(Continued)

OTHER PUBLICATIONS

Office Action mailed Jun. 9, 2015 issued in corresponding JP patent application No. 2012-250858 (and English translation).

(Continued)

*Primary Examiner* — Tho V Duong
*Assistant Examiner* — Raheena Rehman
(74) *Attorney, Agent, or Firm* — Posz Law Group, PLC

(57) ABSTRACT

An outdoor unit for an air conditioner, comprising: a heat exchanger disposed inside a housing; and a bottom plate of the housing, including, a bottom plate portion, a flange formed by upwardly folding back an edge of the bottom plate portion, a drainage hole penetrating the bottom plate portion and configured to discharge water, a plurality of mounting bases protruding upwardly from the bottom plate portion and supporting a lower end of the heat exchanger by upper surfaces thereof, and a drainage conduit provided in contact with the mounting bases and inclining downward toward the drainage hole, wherein a portion of the bottom plate portion positioned between at least one of the plurality of the mounting bases and the flange includes an inclined portion which is inclined toward the drainage conduit in a longitudinal direction of the flange.

14 Claims, 18 Drawing Sheets

(56) References Cited

U.S. PATENT DOCUMENTS

| | | | | |
|---|---|---|---|---|
| 6,868,689 | B1 * | 3/2005 | McNeil | F24F 13/222 62/285 |
| 7,210,305 | B2 * | 5/2007 | Shin | 62/285 |
| 2007/0169501 | A1 * | 7/2007 | Rios | 62/286 |
| 2008/0022615 | A1 * | 1/2008 | Fox | F24F 13/222 52/302.1 |
| 2009/0249812 | A1 * | 10/2009 | Timbs et al. | 62/285 |
| 2010/0116461 | A1 * | 5/2010 | Saito et al. | 165/62 |
| 2011/0126917 | A1 * | 6/2011 | Nakata et al. | 137/268 |
| 2014/0131024 | A1 | 5/2014 | Iwazaki et al. | |
| 2014/0165640 | A1 * | 6/2014 | Takeuchi | F25D 21/14 62/275 |
| 2014/0202191 | A1 * | 7/2014 | Jinnai | F25D 21/14 62/275 |

FOREIGN PATENT DOCUMENTS

| | | | |
|---|---|---|---|
| CN | 203615503 | U | 5/2014 |
| EP | 2180267 | A2 | 4/2010 |
| JP | S52-86262 | U | 6/1977 |
| JP | 61-63667 | U | 4/1986 |
| JP | S63-83529 | U | 6/1988 |
| JP | 1-26998 | Y2 | 8/1989 |
| JP | 08-086474 | A | 4/1996 |
| JP | 09-287774 | A | 11/1997 |
| JP | 2001-317766 | A | 11/2001 |
| JP | 2005049002 | A * | 2/2005 |
| JP | 2005-188837 | A | 7/2005 |
| JP | 2009-138951 | A | 6/2009 |
| WO | 2011/027709 | A1 | 3/2011 |

OTHER PUBLICATIONS

Office Action mailed Nov. 18, 2014 issued in corresponding JP patent application No. 2012-250858 (and English translation).

Office Action mailed Sep. 29, 2015 issued in corresponding JP patent application No. 2015-000187 (and English translation).

Chinese Office Action issued on Dec. 28, 2015 in the corresponding CN application No. 201310586044.6(English translation attached).

* cited by examiner

OUTDOOR UNIT FOR AIR CONDITIONER

CROSS-REFERENCE TO RELATED APPLICATIONS

This application claims priority from Japanese Patent Application No. 2012-250858 filed on Nov. 15, 2012, the entire contents of which are incorporated herein by reference.

TECHNICAL FIELD

Aspects of the present invention relate to an outdoor unit for an air conditioner, and more particularly, to a drainage structure of drain water.

BACKGROUND

An outdoor unit for an air conditioner includes a housing of a substantially rectangular parallelepiped shape. A compressor, an outdoor heat exchanger (hereinafter referred to as a heat exchanger), and a fan are installed in the housing. A partition is interposed between a section provided with the compressor and a section provided with the heat exchanger and the fan. The heat exchanger is disposed in a substantially L-shape along a lateral side of the housing. A bottom plate forming a bottom portion of the housing is provided with a drainage hole penetrating the bottom plate, so that water collected in the housing is discharged from the drainage hole. For this reason, the drainage hole is located at the lowest position of the bottom plate. The bottom plate of the section provided with the heat exchanger and the fan has a drainage conduit connected to the drainage hole, so that the water in the housing is guided by the drainage groove to flow to the drainage hole. Further, loading shelves having a predetermined height from the position of the drainage hole in its vertical direction protrude inwardly from the lateral face of the housing at plural portions, and the heat exchanger is placed on the loading shelves. For this reason, lower ends of the heat exchanger are positioned at a position higher than the drainage conduit. In this way, the water collected in the outdoor unit is discharged outwardly from the outdoor unit, and the lower ends of the heat exchanger and the fan are not submerged in the water flowing along the drainage conduit.

The heat exchanger of the outdoor unit for the air conditioner is, for example, a fin-tube heat exchanger including thin plate-like fins made of aluminum and arranged horizontally, and heat exchange tubes penetrating the fins, in which when refrigerant flowing in the heat exchanger tubes is heat-exchanged with external air from the fan, a contact area between the heat exchanger tubes and the air is increased by the fins to improve a heat exchange efficiency.

At a heating operation to heat an inside of a room, the cold refrigerant flows in the heat exchanger tubes of the heat exchanger, and vapor in the external air is cooled in the heat exchange tubes to become dew water which is adhered to the heat exchange tubes and perimeters of fins. The dew water flows down along the heat exchange tubes and the fins, and then drips onto the bottom plate. The dew water is known as drain water, and flows to the drainage hole through the drainage conduit provided in the bottom plate to be discharged from the outdoor unit. In a case where the drain water is not smoothly led to the drainage hole, the drain water is locally collected around the heat exchanger or the bottom plate, which leads to an adverse effect on the operation of the fan or the heat exchanger.

In particular, in cold climates, the drain water becomes frost and causes frost formation on the heat exchanger tubes or fins. When the frost adhered to the heat exchanger is melted by defrost operation which is regularly or occasionally performed, a large volume of water flows down to the bottom plate. The large volume of water is not discharged outwardly from the outdoor unit, but remains on the bottom plate of the outdoor unit which may be frozen. If the ice grows around the heat exchanger or the fan, it is disruptive to rotation of the fan, or the heat exchanger tubes of the heat exchanger are deformed by application of the pressure from its perimeter due to the ice.

Several drainage structures capable of guiding the drain water to the drainage hole have been proposed in the outdoor unit for the air conditioner. For example, related-art discloses an outdoor unit in which loading shelves on which the heat exchanger is partially loaded, and a drainage conduit are disposed on a bottom plate of a housing to be adjacent to each other, and the bottom plate of the heat exchanger is provided with a gutter communicating the heat exchanger loading shelves and the drainage conduit at one side of the heat exchanger (e.g., see JP-A-2005-188837 (FIGS. 1 and 2)).

According to the outdoor unit for the air conditioner of the related art, the loading shelves are installed near an edge of the bottom plate, an about half portion (back face side) of the heat exchanger is loaded on the loading shelves, and the remaining portion (front face side) of the heat exchanger in a width direction (width direction of fin) is positioned near a center of the bottom surface. In addition, the bottom plate of the lower portion of the heat exchanger is provided with the gutter inclining downward toward the drainage conduit, and the heat exchanger loading shelves at the rear side of the heat exchanger and the drainage conduit are communicated each other. With the configuration, the drain water generated from the front side of the heat exchanger directly drips onto the drainage groove, while the drain water generated from the rear side of the peripheral portion and flowing down to the heat exchanger loading shelves is usually led to the drainage conduit through the gutter.

SUMMARY

However, the drain water generated from the rear side of the peripheral portion might be collected on the upper surface of the flat portion of the heat exchanger loading shelves. In particular, since the heat exchanger loading shelves are connected to a flange formed by upwardly folding back the lateral side of the outdoor unit housing, that is, the edge of the bottom plate, at the peripheral portion, there is a problem in that if the drain water drips on the boundary between the flange and the heat exchanger loading shelves, the drain water is not discharged, but is collected thereon. If the drain water collected thereon is frozen, there is fear that the heat exchanger loaded on the loading shelves is deformed by the grown ice.

Accordingly, there is provided a highly reliable outdoor unit for an air conditioner which can quickly discharge drain water without collecting it around the heat exchanger, and suppress growth of ice on a bottom plate to prevent the heat exchanger from being deformed.

According to an aspect of the present invention, there is provided an outdoor unit for an air conditioner, the outdoor unit including: a heat exchanger disposed inside a substantially rectangular parallelepiped housing along a lateral face of the housing; and a bottom plate forming a bottom portion of the housing, the bottom plate including, a bottom plate portion, a flange formed by upwardly folding back an edge of the bottom plate portion, a drainage hole penetrating the bottom plate portion and configured to discharge water inside the housing to an outside of the housing, a plurality of mounting bases provided on the bottom plate portion, protruding upwardly from the bottom plate portion at positions spaced apart from the flange by a predetermined distance, and supporting a lower end of the heat exchanger by upper surfaces thereof, and a drainage conduit provided in contact with the mounting bases and inclining downward toward the drainage hole, wherein a portion of the bottom plate portion positioned between at least one of the plurality of the mounting bases and the flange includes an inclined portion which is inclined toward the drainage conduit in a longitudinal direction of the flange.

According to another aspect of the present invention, there is provided an outdoor unit for an air conditioner, the outdoor unit including: a heat exchanger disposed inside a substantially rectangular parallelepiped housing along a lateral face of the housing; and a bottom plate forming a bottom portion of the housing, the bottom plate including, a bottom plate portion, a flange formed by upwardly folding back an edge of the bottom plate portion, a drainage hole penetrating the bottom plate portion and configured to discharge water inside the housing to an outside of the housing, a positioning wall including a protrusion portion which protrudes from the flange toward an inner side of the housing and is configured to determine a position of a lateral portion of the heat exchanger by abutting on the lateral portion of the heat exchanger, and a drainage conduit provided on a portion of the bottom plate portion in contact with the positioning wall and inclining downward toward the drainage hole, wherein an upper surface of the positioning wall is inclined downward toward the drainage conduit.

Accordingly, the bottom plate portion around the mounting base of the heat exchanger is inclined toward the drainage conduit, so that the drain water can be quickly discharged, without being collected around the mounting bases. Accordingly, there is the effect of providing the highly reliable outdoor unit for the air conditioner which can prevent the deformation of the heat exchanger due to the freeze of the drain water.

In addition, the drain water is not collected on the upper surface of the positioning wall for positioning the lateral portion of the heat exchanger, so that the drain water can be quickly discharged. Accordingly, there is the effect of providing the highly reliable outdoor unit for the air conditioner which can prevent the deformation of the heat exchanger due to the freeze of the drain water.

DETAILED DESCRIPTION

First Embodiment

Figure 1:
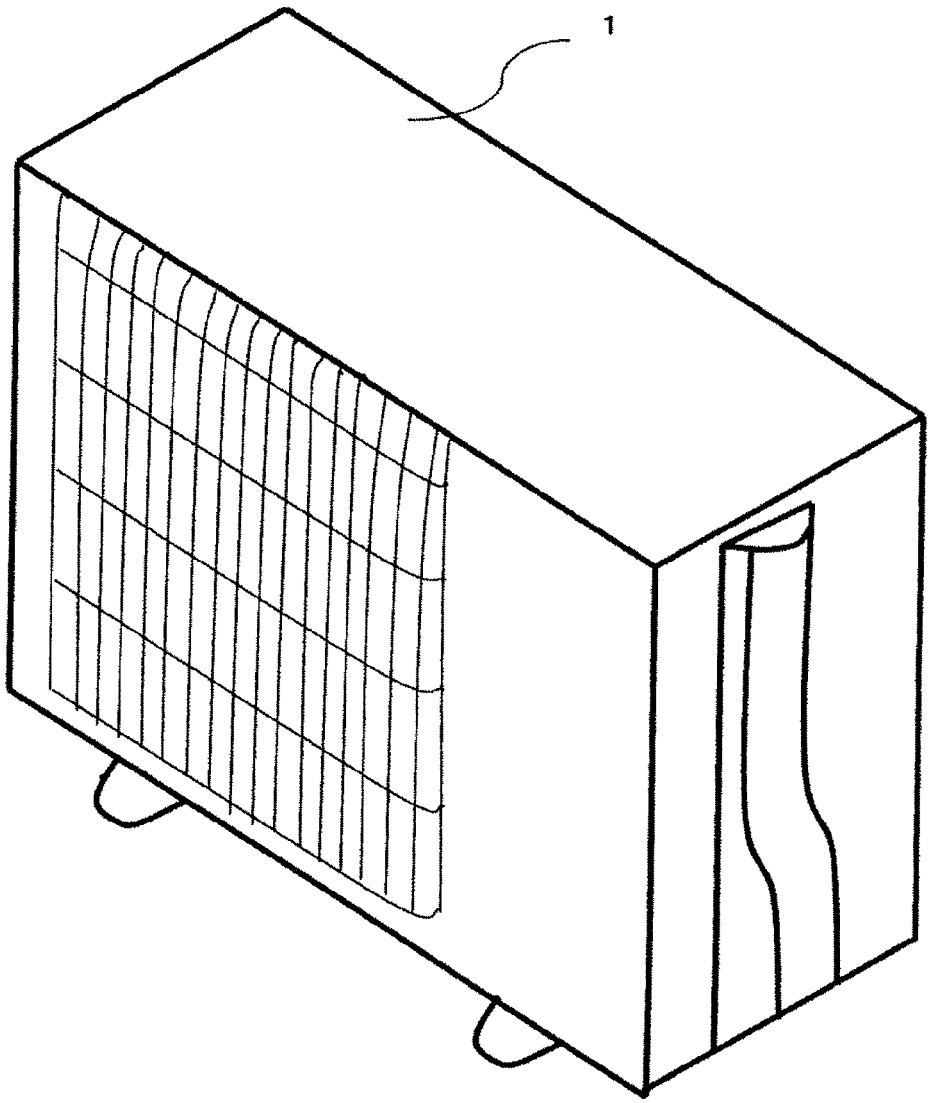
FIG. 1 is a perspective view illustrating a housing according to a first embodiment of the present invention.
Figure 2:
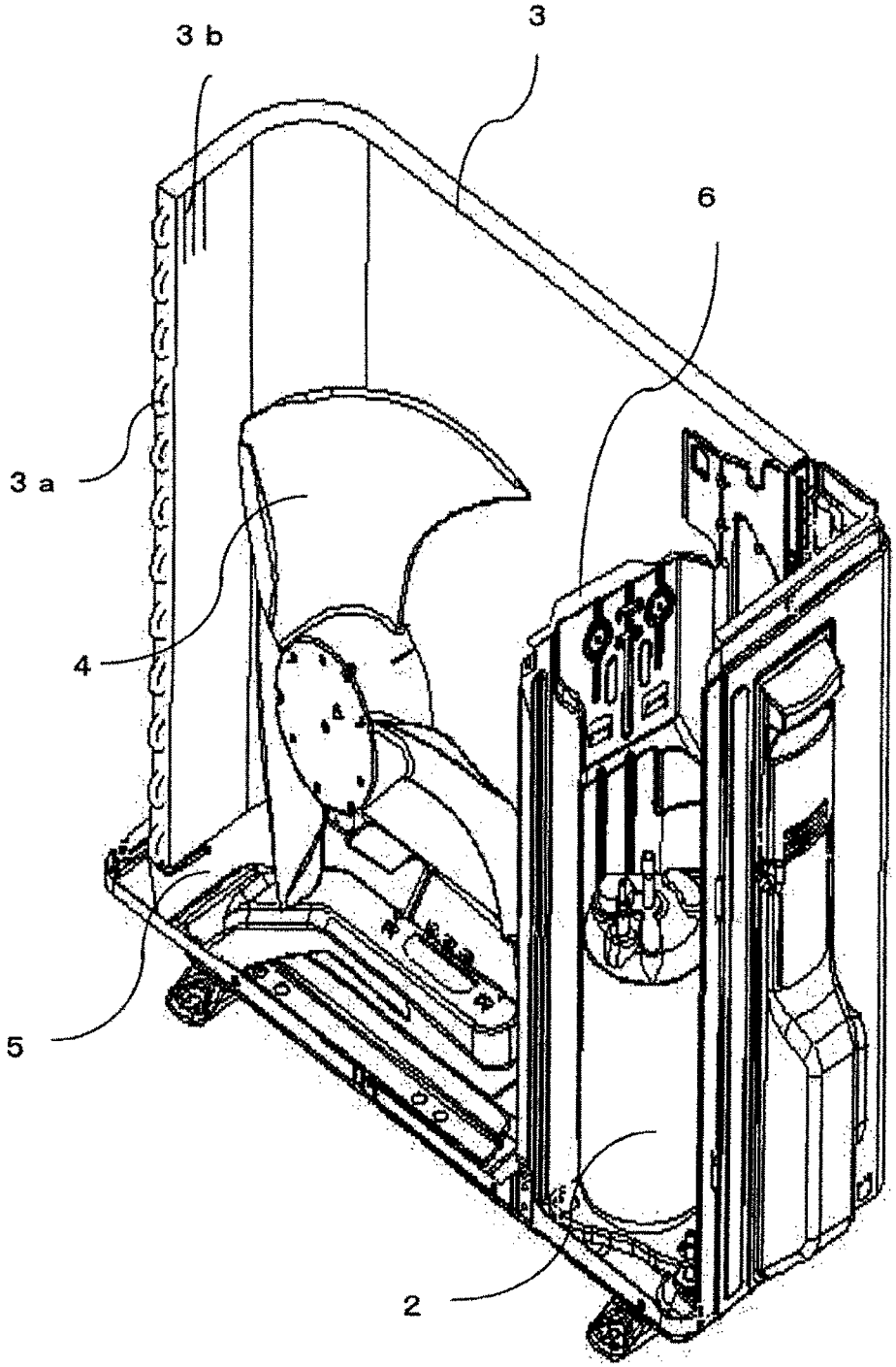
FIG. 2 is a perspective view illustrating an interior of the housing according to the first embodiment of the present invention, with a portion of the housing being removed.

An outdoor unit for an air conditioner according to the first embodiment of the present invention will now be described. FIG. 1 is a perspective view illustrating a housing 1 of the outdoor unit for the air conditioner according to the first embodiment of the present invention, and the housing 1 is made of a sheet metal of a substantially rectangular parallelepiped shape. Further, FIG. 2 is a perspective view illustrating an interior of the housing 1, with a portion of the housing 1 being removed. As illustrated in FIG. 2, the housing 1 houses a compressor 2 for compressing refrigerant, an outdoor heat exchanger 3, and a fan 4. A bottom plate 5 forming a bottom portion of the housing 1 is provided with unit attaching portions which are formed by, for example, pressing, and the respective units are mounted to each attaching portion. A partition 6 is formed between a section for housing the compressor 2 and a section for housing the heat exchanger 3 and the fan 4. The heat exchanger 3 is, for example, a fin-tube heat exchanger including thin plate-like fins 3*b* made of aluminum and arranged horizontally, and heat exchange tubes 3*a* penetrating the fins. The heat exchanger is disposed along two sides which are formed in a substantially L-shaped as whole to constitute the housing 1. The fan 4 is installed adjacent to the heat exchanger 3, and external air passes through the heat exchanger 3 by the fan 4. At that time, refrigerant flowing in the heat exchanger tubes 3*a* of the heat exchanger 3 is heat-exchanged with the external air.

In a fabrication process, after each unit (the compressor 2, the heat exchanger 3, the fan 4, the partition 6, and so forth) is attached to the bottom plate 5, later sides and an upper side of the housing 1 are fixed to the bottom plate 5 to thereby form the housing 1.

Figure 3:
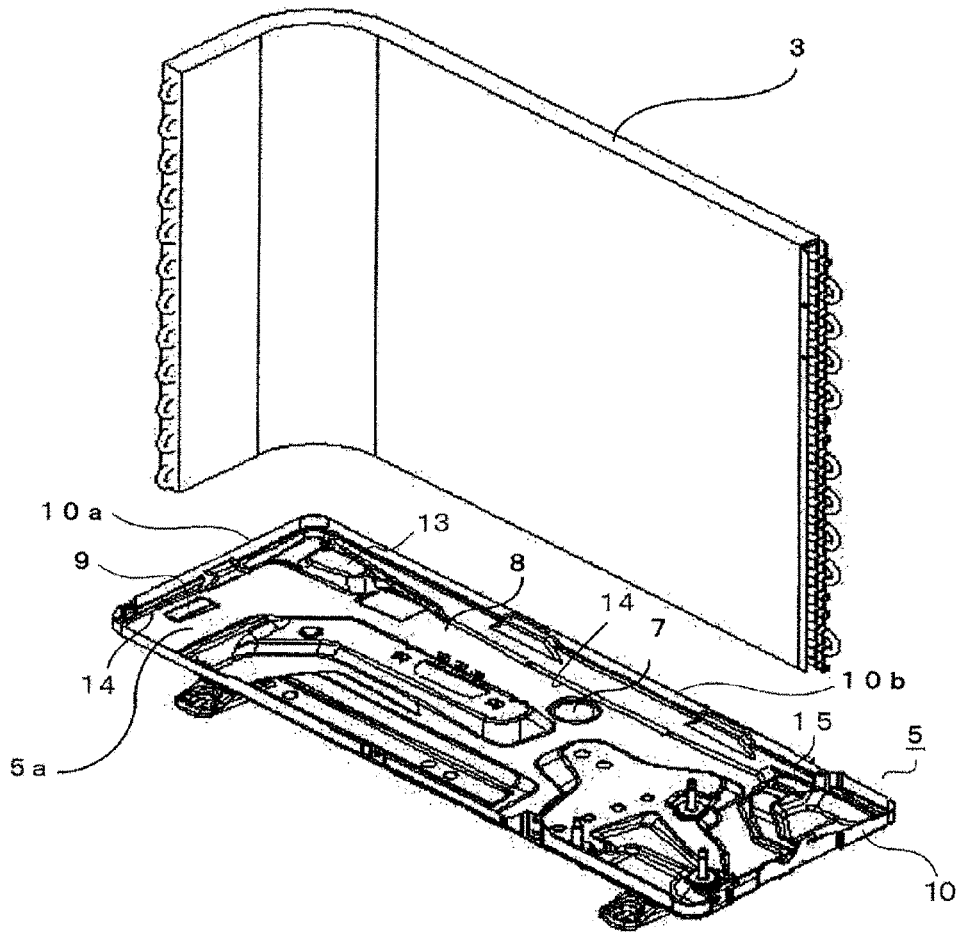
FIG. 3 is a diagram illustrating a heat exchanger and a bottom plate according to the first embodiment of the present invention.
Figure 4:
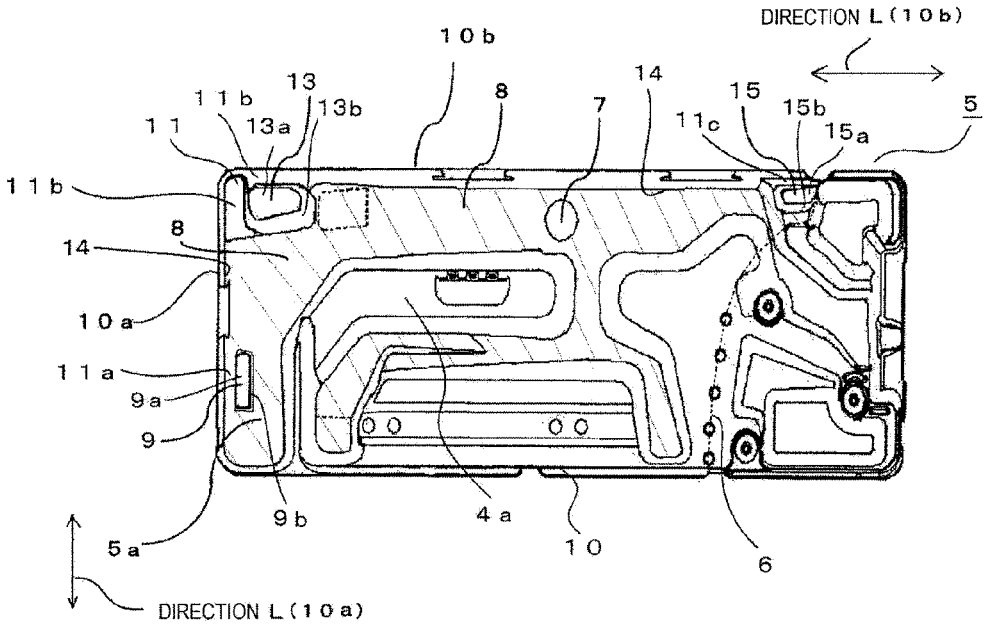
FIG. 4 is a plan view illustrating the bottom plate according to the first embodiment of the present invention.

FIG. 3 is a diagram illustrating the heat exchanger 3 and the bottom plate 5, and FIG. 4 is a plan view illustrating the bottom plate 5. As illustrated in FIGS. 3 and 4, the bottom plate 5 is provided with a drainage hole 7 penetrating the bottom plate 5 at a center portion of the bottom plate in a left and right direction thereof, so that the drain water generated from the heat exchanger 3 and rainwater entering the housing 1 from an air outlet of the fan 4 are discharged from the drainage hole 7 to the exterior of the outdoor unit. The drainage hole 7 is installed at the lowest position of the bottom plate 5 in a vertical direction. Further, although the drainage hole 7 may be installed at any position when seen from a plan view, it is preferable that the drainage hole is installed near the installation position of the heat exchanger 3 where the drain water is easily generated. A hose or the like is connected to the drainage hole 7 at a lower side of the bottom plate 5, so that the drain water flowing from the drainage hole 7 is led to the exterior of the housing 1 through the hose, and then is discharged to a drain around a building, for example.

The bottom plate 5 includes of a bottom plate portion 5*a* forming the bottom portion of the housing 1, and a flange 10 formed by upwardly folding back an edge of the bottom plate portion 5*a*, for example, about 1 to 5 cm, at about 90 degrees. In the fabrication process, the lateral side of the housing 1 is fastened to the flange 10 by screws or like. In a case where an L-shaped heat exchanger 3 is installed, the heat exchanger is installed along two lateral sides of the housing 1. Two sides of the flange 10 among four sides thereof, which are provided along the installation position of the heat exchanger 3, are denoted by flanges 10*a* and 10*b*. A folded-back portion 14 extending from the edge of the bottom plate portion 5*a* to the flange 10 is formed in a rounded curve, and the flange 10 extending to the folded-back portion 14 has a smooth stepped portion. Further, a direction of the flange 10 extending along four sides of the bottom plate portion 5*a* is denoted by a longitudinal direction L of the flange 10. That is, as illustrated in FIG. 4, the longitudinal direction of the flange 10*a* is a direction L(10*a*), and the longitudinal direction of the flange 10*b* is a direction L(10*b*).

The bottom plate 5 housing the heat exchanger 3 and the fan 4 has a drainage conduit 8 connected to the drainage hole 7. In addition, the partition 6 between the sections for housing the compressor 2 is indicated by a dotted line in FIG. 4, and the drainage conduit 8 provided to the section for housing the heat exchanger 3 and the fan 4 is indicated by a hatched line in FIG. 4. The drainage conduit 8 is formed to be inclined from the edge of the bottom plate portion 5*a* to the drainage hole 7, so that the drain water dripping on the bottom plate 5 is led to the drainage hole 7 via the drainage conduit 8. Also, since the heat exchanger 3 generating the drain water is installed inside the flanges 10*a* and 10*b* along the flanges 10*a* and 10*b*, the drainage conduit 8 is formed to be inclined from the folded-back portion 14 of the flanges 10*a* and 10*b* to the drainage hole 7. To quickly discharge the rainwater entering the housing 1, as well as the drain water, the drainage conduit 8 is installed to be inclined from each portion of the bottom plate portion 5*a* to the drainage hole 7. In this instance, the drainage conduit 8 is inclined downward toward the drainage hole 7, but it need not be a monotonous slope, but may have a partially flat surface or a stepped portion. In addition, the bottom plate 5 is provided with a concave portion by press molding, for example, as well as a mounting base 9 on which the heat exchanger 3 is loaded, to increase its rigidity.

A plurality of, for example, three, mounting bases 9, 13 and 15 for supporting the lower end of the heat exchanger 3 are provided to be scattered in a plurality of locations on the bottom plate 5. To reliably support the heat exchanger 3, three mounting bases, that is, the mounting bases 9 and 15 provided near both ends of the substantially L-shaped heat exchanger in the left and right directions (a parallel direction of the fin 3*b*) and the mounting base 13 provided near a corner portion at which the center portion of the heat exchanger 3 is bent at about 90 degrees, protrude upwardly from the inside of the housing 1 in a highland shape. The lower end of the heat exchanger 3 is supported by upper surfaces 9*a*, 13*a* and 15*a* (flat surfaces) of the protrusions of the mounting bases 9, 13 and 15. The mounting bases 9, 13 and 15 are provided at positions spaced apart from the flange 10 (10*a* and 10*b*) by a predetermined distance, and the bottom plate portion 5*a* between the mounting base 9 and the flange 10 are inclined in the longitudinal direction L of the flange 10 to form an inclined portion 11 (11*a*, 11*b* and 11*c*) facing the drainage conduit 8. The upper surfaces 9*a*, 13*a* and 15*a* of the mounting bases 9, 13 and 15 are formed as a flat surface to easily fix the heat exchanger 3. Also, a side of the respective mounting bases 9, 13 and 15 which does not face the flange 10 (10*a* and 10*b*) contacts with the drainage conduit 8 at lateral faces 9*b*, 13*b* and 15*b* of the mounting base, which are inclined surfaces smoothly widened toward its end. Further, a width of the flat surface of the upper surfaces 9*a*, 13*a* and 15*a* of the mounting bases is equal to or shorter than a width of the heat exchanger 3. The width of the heat exchanger 3 means a length of a direction (not the vertical direction) perpendicular to the longitudinal direction (a parallel direction of the fins) of the heat exchanger 3, and is substantially equal to the width (e.g., 10 to 30 mm) of one sheet of fin.

Figure 5:
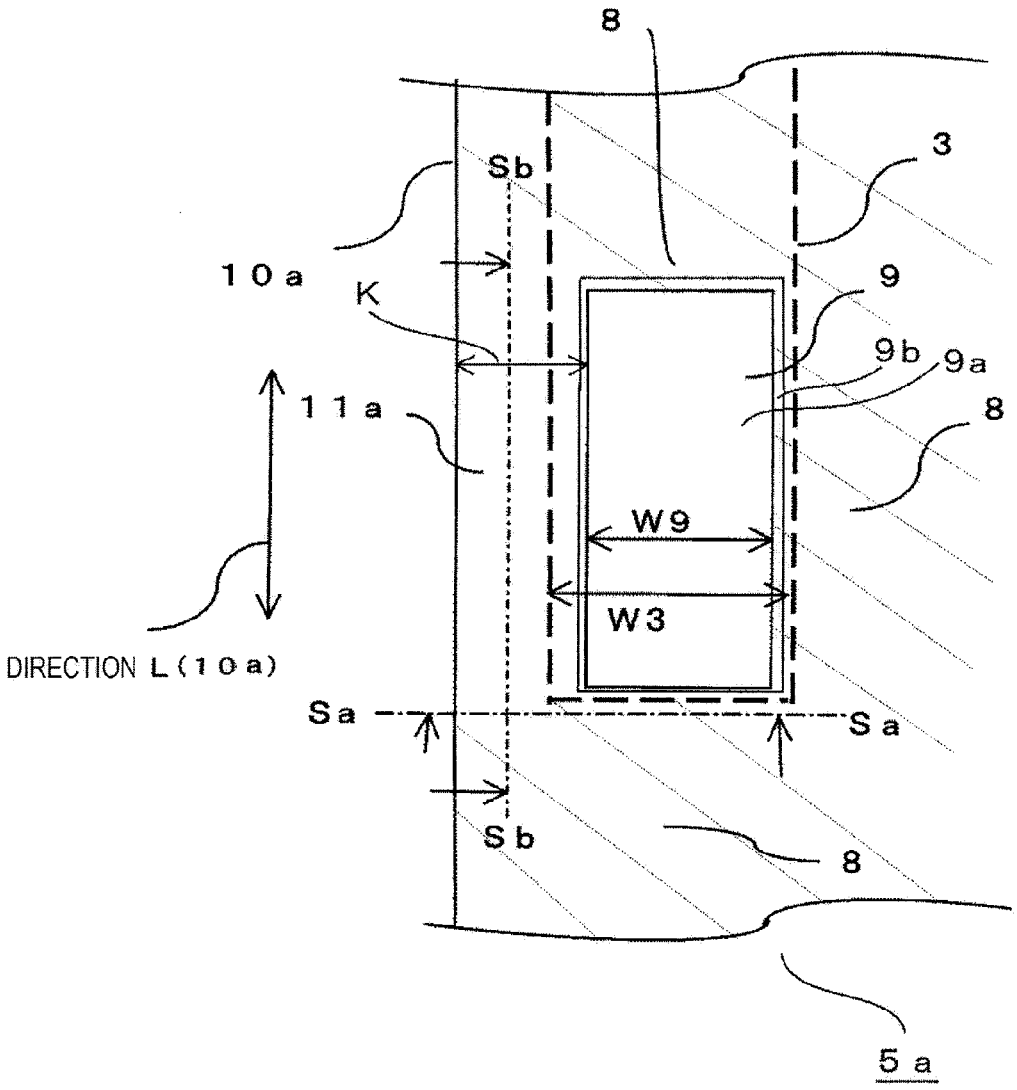
FIG. 5 is a diagram illustrating an upper surface of the bottom plate around a mounting base according to the first embodiment of the present invention.
Figure 6:
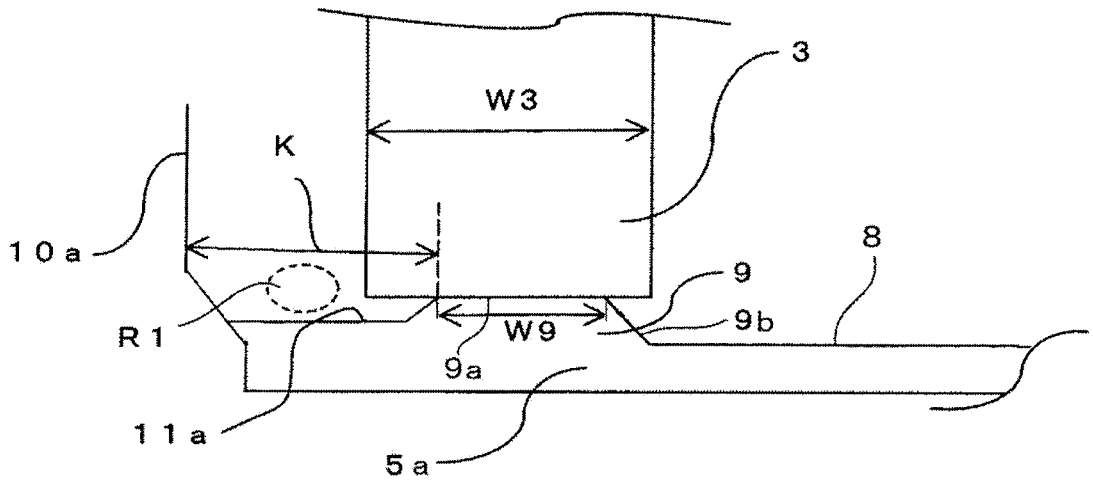
FIG. 6 is a cross-sectional view taken along the line Sa-Sa in FIG. 5 to illustrate the bottom plate around the mounting base according to the first embodiment of the present invention.
Figure 7:
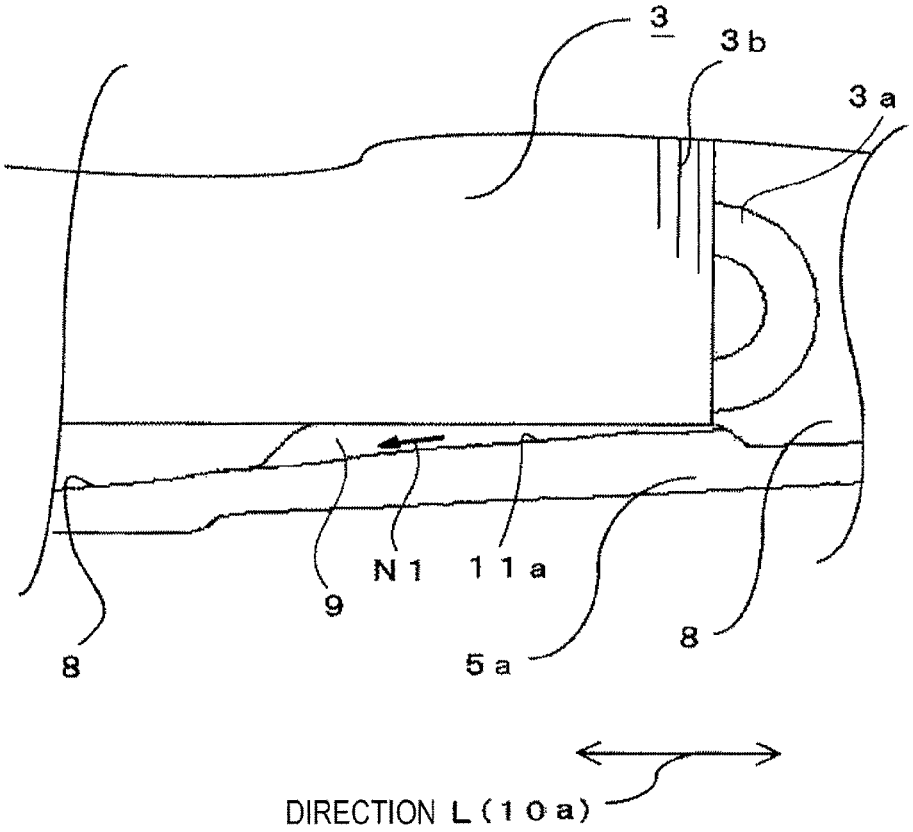
FIG. 7 is a cross-sectional view taken along the line Sb-Sb in FIG. 5 to illustrate the bottom plate around a mounting base according to the first embodiment of the present invention.

Next, the respective mounting bases 9, 13 and 15 and the bottom plate portion 5*a* around the mounting bases will be described. First, the mounting base 9 and the bottom plate portion 5*a* around the mounting base 9 will be described. FIG. 5 is a diagram illustrating an upper surface of the bottom plate portion 5*a* around the mounting base 9 according to the first embodiment of the present invention. FIG. 6 is a cross-sectional view taken along the line Sa-Sa in FIG. 5. FIG. 7 is a cross-sectional view taken along the line Sb-Sb in FIG. 5. In FIG. 5 the mounting position of the heat exchanger 3 is indicated by a dotted line, and the heat exchanger 3 is also illustrated in FIGS. 6 and 7.

The mounting base 9 is installed at a position spaced apart from the flange 10 which is closest to the mounting base 9, by a predetermined distance K. Herein, the flange-side end of the upper surface 9*a* of the mounting base is spaced apart from the flange 10*a* by about 10 mm. For this reason, the heat exchanger 3 is fixed to the mounting bases far from the flange 10*a*. As illustrated in FIG. 6, the bottom plate portion 5*a* between the heat exchanger 3 and the mounting base 9 has the inclined portion 11*a* which is lower than the height of the upper surface 9*a* of the mounting base and is inclined in a longitudinal direction of which the flange 10*a* closest to the mounting base 9 extends, that is, the direction L(10*a*). The inclined portion 11*a* inclines downward toward a direction close to the drainage hole 7, and a front portion of the inclined portion 11*a* faces the drainage conduit 8.

As illustrated in FIGS. 5 and 6, a width W9 of the upper surface 9*a* of the mounting base is formed to be shorter than a width W3 of the heat exchanger 3. Both ends of the heat exchanger 3 in the width direction are disposed to protrude outwardly from the upper surface 9*a* of the mounting base.

According to the outdoor unit for the air conditioner, at the time of a heating operation to heat an interior, the drain water generated when the external air is cooled in the heat exchanger 3 directly drips onto the mounting base 9 and its surroundings along the fins of the heat exchanger 3. The drain water flows to the drainage conduit 8 at a portion around the mounting base 9 which contacts with the drainage conduit 8. Further, the drain water dripping onto the portion of the mounting base 9 close to the flange 10*a*, that is, the region R1 in FIG. 6, is not collected in the region R1, as illustrated in FIG. 7, but flows toward the drainage conduit 8 along the inclined portion 11*a* in the direction indicated by the arrow N1, to be discharged from the drainage hole 7. In this way, the drain water generated when the external air is cooled by the heat exchanger 3 is not collected on the mounting base 9, but is led to the drainage conduit 8 by the inclined portion 11*a* around the mounting base 9 or the lateral face 9*b* of the mounting base, and then is quickly discharged from the housing 1 through the drainage hole 7.

Both ends of the heat exchanger 3 protrude from the mounting base 9, and the lateral face 9*b* of the mounting base 9, the drainage conduit 8, or the inclined portion 11*a* is formed just below the protruding portions of the both ends of the heat exchanger 3. The drain water dripping onto the upper surface 9*a* of the mounting base along the fins of the heat exchanger 3 is dragged by the flow running down from both ends of the upper surface 9*a* of the mounting base, and then easily flows to the bottom plate portion 5*a* from both ends of the heat exchanger 3 in the width direction.

The width of the heat exchanger 3 (in a direction perpendicular to the longitudinal direction of the heat exchanger and a width of one sheet of fin) may be equal to the width of the upper surface 9*a* of the mounting base. It is preferable that both ends of the heat exchanger 3 protrude from both ends of the mounting base 9. However, even if the heat exchanger 3 does not protrude, the drain water dripping onto the portion close to the lateral face 9*b* of the upper surface 9*a* of the mounting base smoothly flows along the inclination of the lateral face 9*b*. Since the mounting base 9 is formed in the highland shape protruding upwardly from the bottom plate portion 5*a* around the mounting base 9, the drain water is hardly collected on the flat portion of the mounting base 9.

Figure 8:
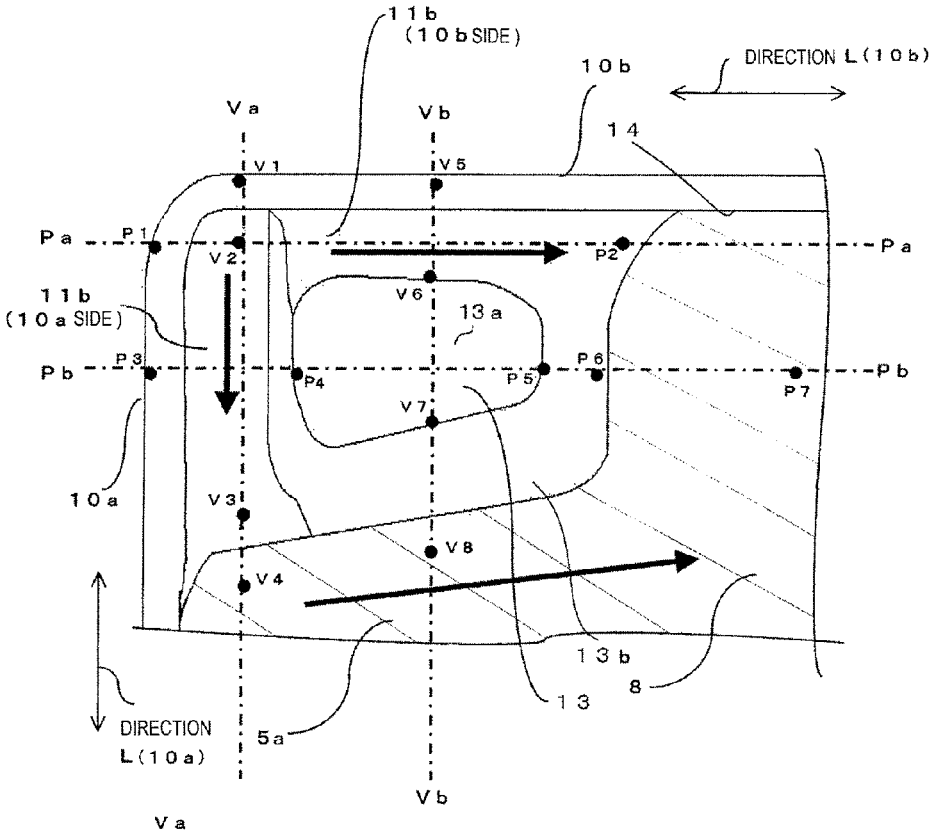
FIG. 8 is a diagram illustrating the upper surface of the bottom plate around the mounting base according to the first embodiment of the present invention.

Next, the mounting base 13 and the bottom plate portion 5*a* around the mounting base will be described. FIG. 8 is a diagram illustrating the upper surface of the bottom plate portion 5*a* around the mounting base 13 according to the first embodiment of the present invention. FIGS. 9A to 9D are diagrams each illustrating the inclination of the surface of the bottom plate 5 denoted by the line Pa-pa (FIG. 9A), the line Pb-Pb (FIG. 9B), the line Va-Va (FIG. 9C), and the line Vb-Vb (FIG. 9D) in FIG. 8. In FIG. 8 the drainage conduit 8 is indicated by the hatched line, and in FIG. 9 the vertical position of the drainage hole 7 provided in the bottom plate portion 5*a* is indicated by the dotted line B.

The mounting base 13 provided at the corner of the rectangular bottom plate 5 has a portion extending in the longitudinal direction L(10*a*) of the flange 10*a*, and a portion extending in the longitudinal direction L(10*b*) of the flange 10*b*. The mounting base 13 according to this embodiment is installed at the position spaced apart from the flange 10*a* and the flange 10*b* by a predetermined distance. For example, the flange-side end of the upper surface 13*a* is installed at the position spaced apart from the flange 10*a* and the flange 10*b* by about 10 to 20 mm. For example, a distance of the flange 10*a* between a flange-side end P4 and a position P3 on the flange 10*a*, and a distance of the flange 10*b* between a flange-side end V6 and a position V5 on the flange 10*b* are set to 10 to 20 mm. The bottom plate portion 5*a* between the flange 10*a* and the mounting base 13 is the inclined portion 11*b* (10*a* side) inclined in the longitudinal direction L(10*a*) of the flange 10*a*. The bottom plate portion 5*a* between the flange 10*b* and the mounting base 13 is the inclined portion 11*b* (10*b* side) inclined in the longitudinal direction L(10*b*) of the flange 10*b*. The inclined portions 11*a* and 11*b* are lower than the height of the upper surface 13*a* of the mounting base. In the drawing, the directions of the downward inclinations of the inclined portions 11*b* (10*a* side) and 11*b* (10*b* side) are indicated by the arrows. The fronts of the downward inclinations of the inclined portions 11*b* (10*a* side) and 11*b* (10*b* side) face the drainage conduit 8 installed on the bottom plate portion 5*a*.

Figure 9A:
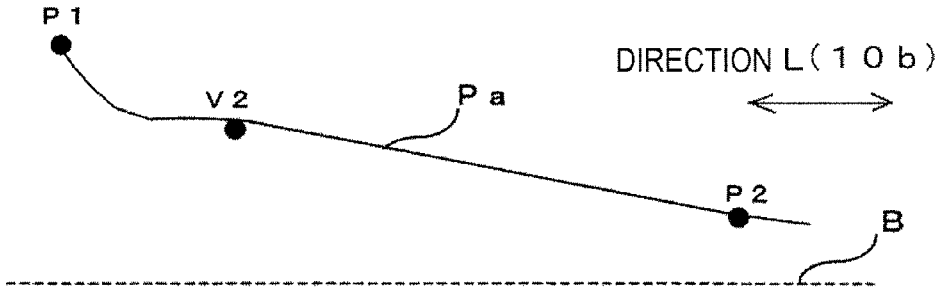
FIGS. 9A to 9D are diagrams each illustrating inclination of a surface of the bottom plate denoted by Pa, Pb, Va and Vb of FIG. 8 according to the first embodiment of the present invention.
Figure 9B:
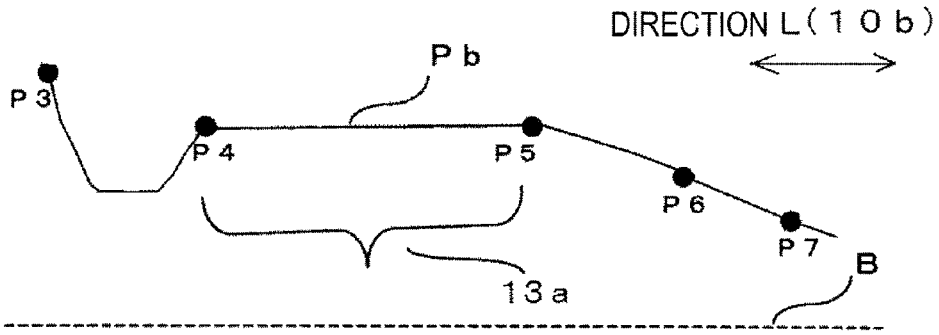
Figure 9C:
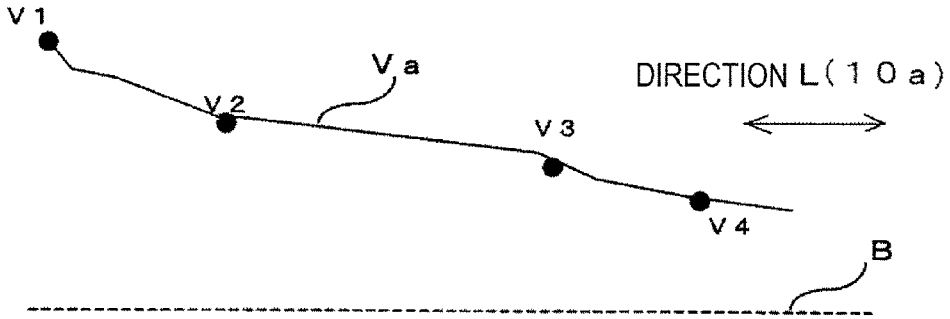
Figure 9D:
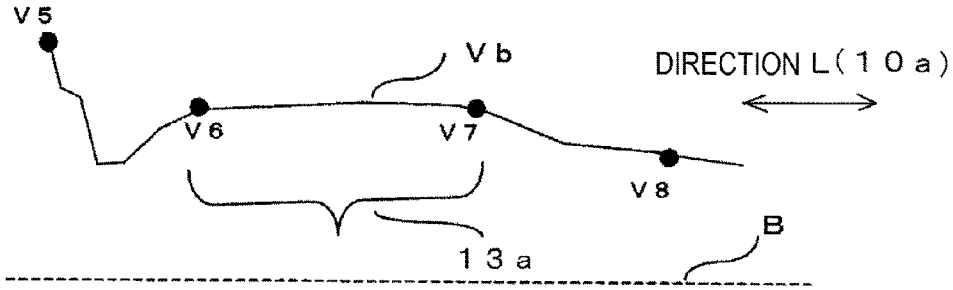

As illustrated in FIG. 9A, the inclined portion 11*b* (10*b* side) inclined in the direction L(10*b* side) is formed from the position V2 to the position P2 on the line Pa-Pa. As illustrated in FIG. 9C, the inclined portion 11*b* (10*a* side) inclined in the direction L(10*a*) is formed from the position V1 to the position V4 on the line Va-Va. In this way, if the bottom plate portion 5*a* between the flanges 10*a* and 10*b* and the bottom base 13 is provided with the inclined portions 11*b* (10*a* side) and 11*b* (10*b* side), as illustrated in FIGS. 9B and 9D, the bottom plate portion 5*a* of the bottom plate 5 is configured so that the upper surface 13*a* of the mounting base mostly protrudes and the surroundings of the side of the mounting base 13 which are extended from the flanges 10*a* and 10*b* are formed as the inclined surface inclining downward. For this reason, the drain water dripping onto the upper surface 13*a* of the mounting base 13 and around the mounting base 13 flows along the inclined portion 10*b* around the mounting base 13, and then is led to the drainage conduit 8. In addition, the drain water flows downward due to the inclination of the drainage conduit 8, and is then discharged from the drainage hole 7. A side of the mounting base 13 which do not extend along the flanges 10*a* and 10*b* is the lateral face 13*b* formed as the inclined surface, and the drain water dripping onto this side also flows to the drainage conduit 8.

Although the bottom plate portion 5*a* positioned near the position V2 is illustrated as a flat state in the direction L(10*b*) in FIG. 9A, since the bottom plate portion 5*a* is inclined in the direction L(10*a*), as illustrated in FIG. 9C, the drain water flows along the inclination of the inclined portion 11*b* (10*a* side) and then is led to the drainage conduit 8. In this way, for the mounting base 13 disposed at the corner of the bottom plate 5, regarding the portion enclosed by an extension line extending along the flange 10*a* and an extension line extending from the flange 10*b*, for example, located near the position V2, it is only necessary that the inclined portion 11*b* is inclined along either of the flange 10. The portion of the inclined portion 11*b* located at the position V2 is inclined in the direction L(10*a*) along the flange 10*a*, but the portion may be inclined in the direction L(10*b*) along the flange 10*b*.

The inclined direction of the inclined portion 11*b* (10*a* side) and the inclined direction of the inclined portion 11*b* (10*b* side) may not face the closest drainage conduit 8. At least one inclined portion 11*b* of the inclined portion 11*b* (10*a* side) and the inclined portion 11*b* (10*b* side) preferably faces the drainage conduit 8. For example, the inclined portion 11*b* (10*b* side) may be inclined downward in the opposite direction, that is, from the position P2 to the position V2. In this instance, the drain water dripping onto the inclined portion 11*b* (10*b* side) flows to the drainage conduit 8 through the inclined portion 11*b* (10*a* side).

As illustrated in FIGS. 9A to 9D, since the mounting base 13 is provided with the drainage conduit 8 and the inclined portion 11*b* around it, even though the drain water drips onto the upper surface 13*a* of the mounting base 13 and around the mounting base 13, the drain water quickly flows to the drainage conduit 8. Since the upper surface of the mounting base according to the related art is configured to be extended to the flange as the intact height, in particular, if the drain water drips onto the flange-side upper surface of the mounting base, the drain water does not flow to any place, but is easily collected thereon. However, in this embodiment, the drain water is smoothly led to the drainage hole 7 by the inclined portion 11*b*.

Figure 10:
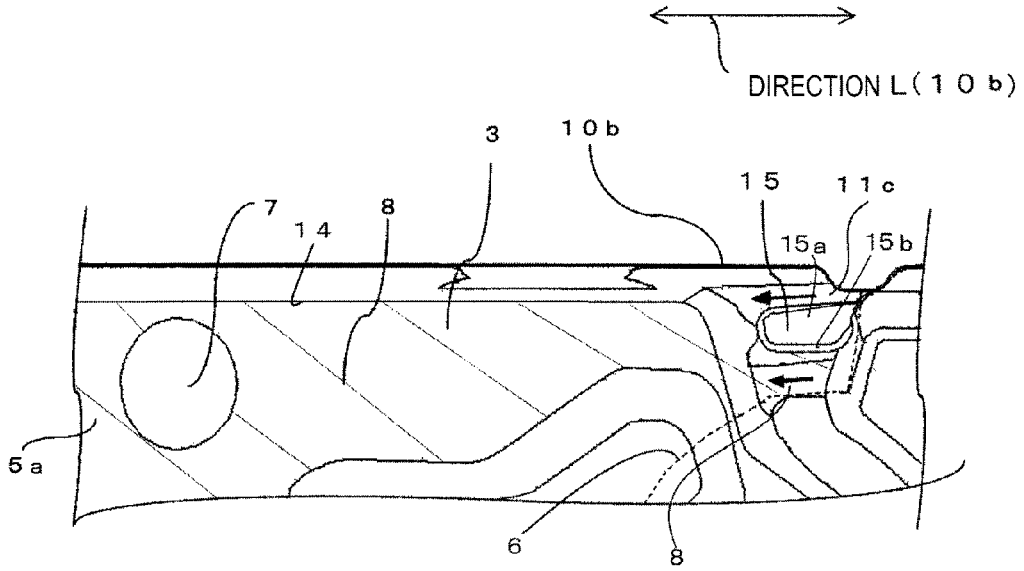
FIG. 10 is a diagram illustrating the upper surface of the bottom plate around the mounting base according to the first embodiment of the present invention.

Next, the mounting base 15 and the bottom plate portion 5*a* around the mounting base 15 will be explained. FIG. 10 is a diagram illustrating the upper surface of the bottom plate portion 5*a* around the mounting base 15 according to the first embodiment of the present invention. The mounting base 15 is substantially identical to the mounting base 9. The mounting base 15 supporting the lower end of the heat exchanger 3 is installed at a position spaced apart from the flange 10*b* by a predetermined distance. For example, the flange-side (10*b*) end of the upper surface 15*a* of the mounting base is spaced apart from the flange 10*b* by about 10 mm. The bottom plate portion 5*a* between the flange 10*b* and the mounting base 15 has the inclined portion 11*c* which is connected to the drainage conduit 8 to be inclined in the longitudinal direction L(10*b*) of which the flange 10*b*. The inclined portion 11*c* is inclined downward toward a direction indicated by the arrow toward the drainage conduit 8 from the position which is lower than the height of the upper surface 15*a* of the mounting base and is higher than the drainage conduit 8.

Also in the mounting base 15, among the drain water dripping onto the upper surface 15*a* of the mounting base 15 and around the mounting base 15, the drain water dripping onto the flange 10*b* side flows along the downward inclination of the inclined portion 10*c*, and then is led to the drainage conduit 8. In addition, the drain water dripping around the side of the mounting base which does not extend along the flange 10*b* flows from the lateral face 15*b* of the mounting base 15 to the drainage conduit 8. The drain water is urged by the inclination of the drainage conduit 8, and then is discharged from the drainage hole 7.

Figure 11A:
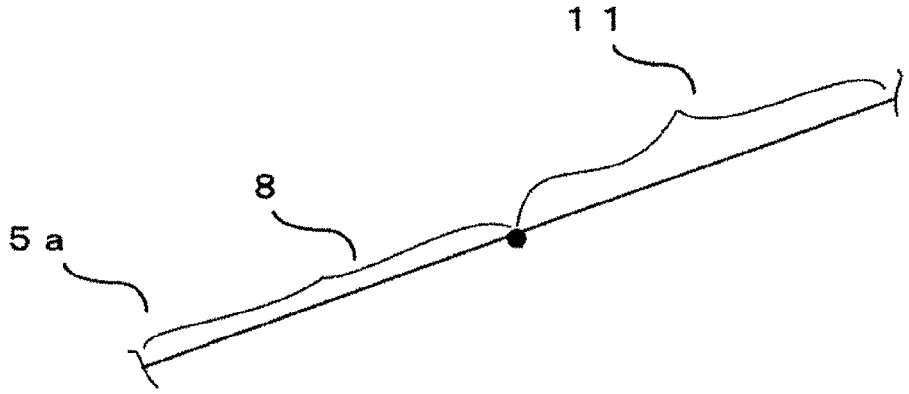
FIGS. 11A to 11D are diagrams illustrating various shapes of the inclination according to the first embodiment of the present invention.
Figure 11B:
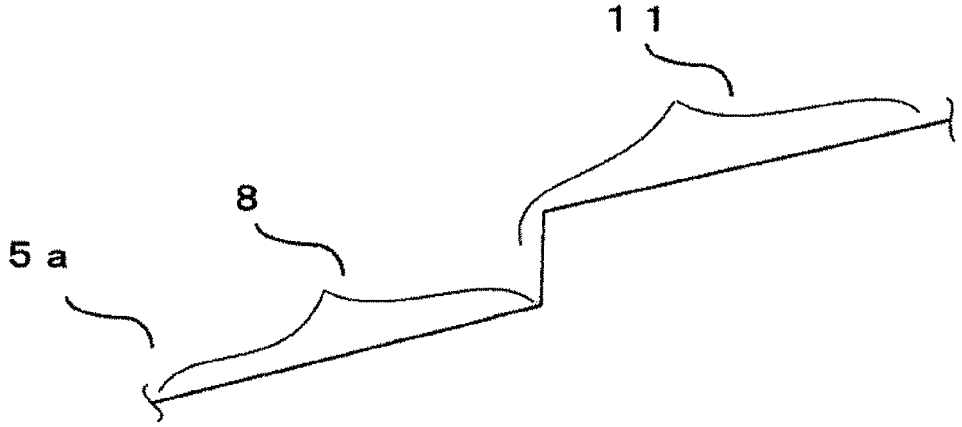
Figure 11C:
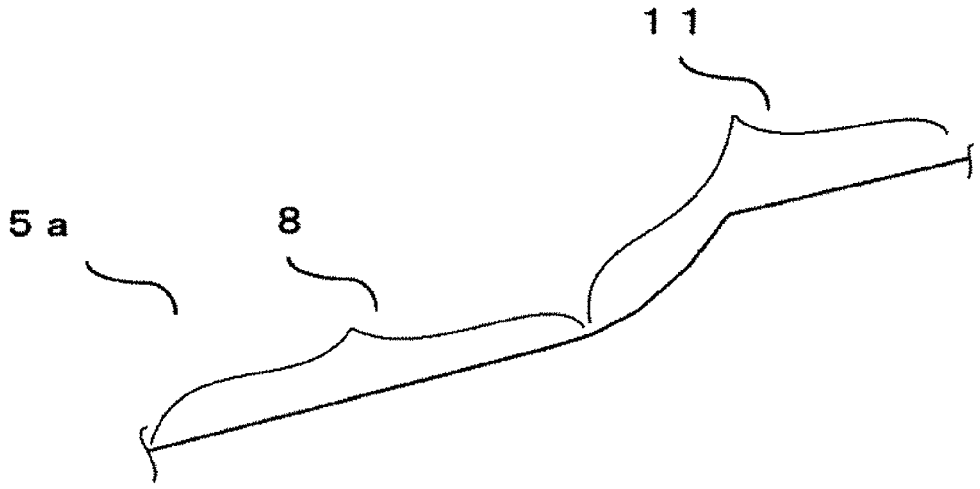
Figure 11D:
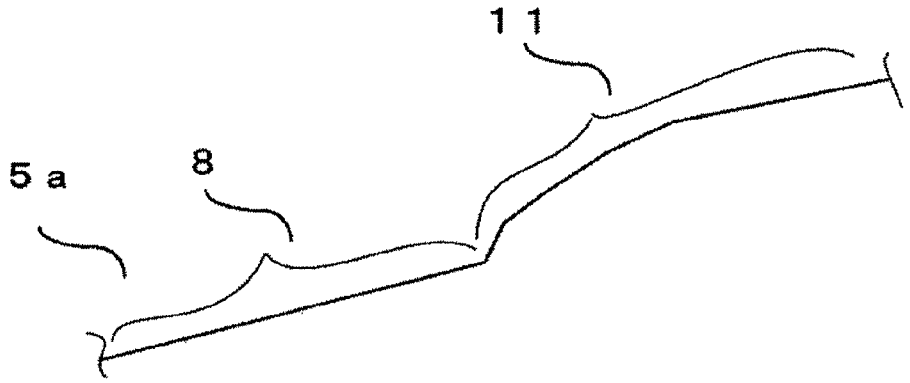

FIGS. 11A to 11D are diagrams illustrating various shapes of the inclined portion 11 inclining toward the drainage conduit 8, and an undulation of the surface of the bottom plate portion 5*a* is shown therein. In FIG. 11A, the inclined portion 11 is connected to the drainage conduit 8 in the shape of a straight line. In FIG. 11B, the inclined portion 11 is connected to the drainage conduit 8 with a stepped portion. In FIGS. 11C and 11D, the inclined portion 11 has a curved portion, in which the inclined portion 11 has a concave curve (FIG. 11C), while the inclined portion 11 has a convex curve (FIG. 11D). In each shape, the inclined portion 11 is inclined downward toward the drainage conduit 8, and the drain water smoothly flows to the drainage conduit 8. In addition, in addition to the shapes illustrated in FIG. 11, the inclined portion may have a plurality of stepped portions or a combination of recesses, and as long as the inclined portion is inclined downward toward the drainage conduit 8, it is not limited to any shapes. The inclined portion 11 is preferably inclined downward toward the drainage conduit 8 from the position which is lower than the upper surfaces 9*a*, 13*a* and 15*a* of the mounting bases 9, 13 and 15 and is higher than the drainage conduit 8.

Even though there is a flat surface between the inclined portion 11 and the drainage conduit 8, the drain water flows downward from the upper side by the inclination fore to or rear to the flat portion, and then flows to the drainage hole 7 which is installed at the lowest position.

Figure 12:
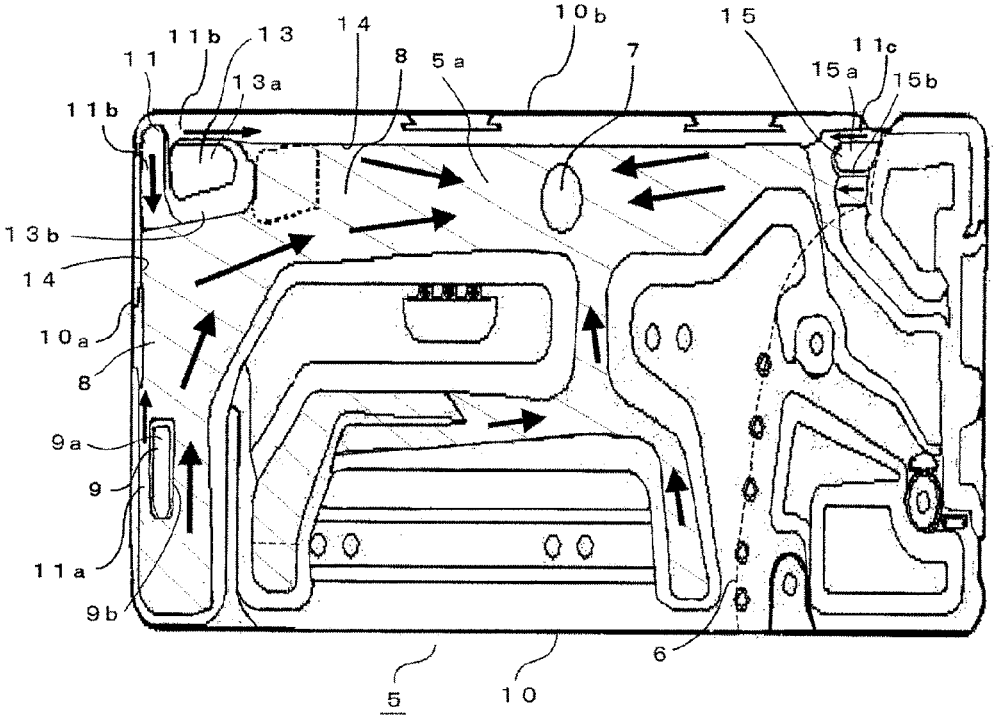
FIG. 12 is a diagram illustrating an inclined direction of the bottom plate according to the first embodiment of the present invention.

FIG. 12 is a diagram illustrating the inclined direction of the entire bottom plate portion 5*a* according to the first embodiment. As illustrated in FIGS. 5 to 10, the drain water dripping onto the upper surfaces 9*a*, 13*a* and 15*a* of the mounting base or around thereof flows along the inclined portions 11*a*, 11*b* and 11*c* or the drainage conduit 9, and thus is almost entirely quickly led to the drainage conduit 8, without being collected locally. The drain water is urged by the inclination of the drainage conduit 8, and thus is discharged from the housing through the drainage hole 7. For this reason, since the drain water can be quickly discharged, without being collected around the heat exchanger 3, the growth of the ice on the bottom plate 5 is suppressed, so that there is provided the highly reliable outdoor unit for the air conditioner which can prevent deformation of the heat exchanger 3 due to freeze of the drain water.

For the bottom plate portion 5*a*, the drainage conduit 8 may not be inclined toward a direction straightly close to the drainage hole 7. If the flow of the water is finally led to the drainage hole 7, the water is not collected on the bottom plate portion 5*a*, and thus it is possible to prevent the drain water or the ice from affecting on each unit.

In this embodiment, the inclination of the inclined portion 11 in the direction L(10*a*) means that if two points spaced apart from each other in the direction L(10*a*) and being parallel to each other are taken, the vertical heights of the bottom plate portion 5*a* at these two points are different. Further, the inclination of the inclined portion 11 in the direction L(10*a*) means that the inclined portion 11 may be inclined at least in the direction L(10*a*), or may also be inclined in a direction other than the direction L(10*a*).

The inclination of the inclined portion 11 in the direction L(10*b*) is also equal to the above description.

Further, although one drainage hole 7 is provided, two or more drainage holes may be provided. Further, three mounting bases 9 are provided, but the present invention is not limited thereto. Two, four or more mounting bases may be provided. In this embodiment, the lateral faces 9*b*, 13*b* and 15*b* forming the mounting bases 9, 13 and 15 of the highland shape are inclined to be widened toward the bottom plate portion 5*a*, but the lateral faces 9*b*, 13*b* and 15*b* may be vertical from the bottom plate portion 5*a*.

Although the outdoor unit including the heat exchanger 3 which is disposed in the L-shape along two lateral faces of the housing 1 has been described herein, a heat exchanger of other shape may be provided. For example, the heat exchanger 3 may be disposed in an I-shape along one lateral face of the housing 1. In this instance, three mounting bases are not necessary, and both ends of the heat exchanger 3 may be supported at two locations. Further, even when the heat exchanger is formed in the L-shape, the number of the mounting bases 9 may not be three.

As described above, according to this embodiment, there is provided the outdoor unit for the air conditioner, the outdoor unit including, the heat exchanger 3 disposed inside the substantially rectangular parallelepiped housing 1 along the lateral face of the housing 1, and the bottom plate 5 forming the bottom portion of the housing 1, the bottom plate 5 including the bottom plate portion 5*a*, the flange 10 formed by upwardly folding back the edge of the bottom plate portion 5*a*, the drainage hole 7 penetrating the bottom plate portion 5*a* and configured to discharge the water inside the housing to an outside of the housing 1, the plurality of mounting bases 9, 13 and 15 provided on the bottom plate portion 5*a*, protruding upwardly from the bottom plate portion at the positions spaced apart from the flange 10 by the predetermined distance, and supporting the lower end of the heat exchanger 3 at the upper surfaces 9*a*, 13*a* and 15*a*, and the drainage conduit 8 provided in contact with the mounting bases 9, 13 and 15 and inclining downward toward the drainage hole 7, wherein the bottom plate portion 5*a* positioned between the mounting bases 9, 13 and 15 and the flange 10 includes the inclined portion 11 inclined toward the drainage conduit 8 in the longitudinal direction L of the flange 10. Accordingly, the drain water can be quickly discharged, without being collected around the mounting bases 9, 13 and 15. Further, the highly reliable outdoor unit for the air conditioner which can prevent the deformation of the heat exchanger 3 due to the freeze of the drain water can be provided.

Further, the inclined portion 11 is inclined downward toward the drainage conduit 8 from the position which is lower than the upper surfaces 9*a*, 13*a* and 15*a* of the mounting bases 9, 13 and 15 and is higher than the drainage conduit 8. Accordingly, the drain water can be quickly discharged, without being collected around the mounting bases 9, 13 and 15. Accordingly, there is the effect of providing the highly reliable outdoor unit for the air conditioner which can prevent the deformation of the heat exchanger 3 due to the freeze of the drain water.

In addition, both ends of the heat exchanger 3 in a width direction thereof (in the direction perpendicular to the longitudinal direction of the heat exchanger and the width of one sheet of fin) protrude outward from upper surfaces 9*a*, 13*a* and 15*a* of the mounting base. Accordingly, the drain water is prevented from being collected around the mounting bases 9, 13 and 15. Also, the drain water flows to the inclined portion 11 or the drainage conduit 8, so that the drain water is quickly discharged from the housing 1 through the drainage hole 7.

Second Embodiment

An outdoor unit for an air conditioner according to the second embodiment of the present invention will now be described. In the second embodiment, the configuration in which the flange 10 is provided with a positioning wall for the heat exchanger 3 will be described. In the drawings, the same reference numerals as those of the first embodiment indicate the same or equivalent parts.

Figure 13:
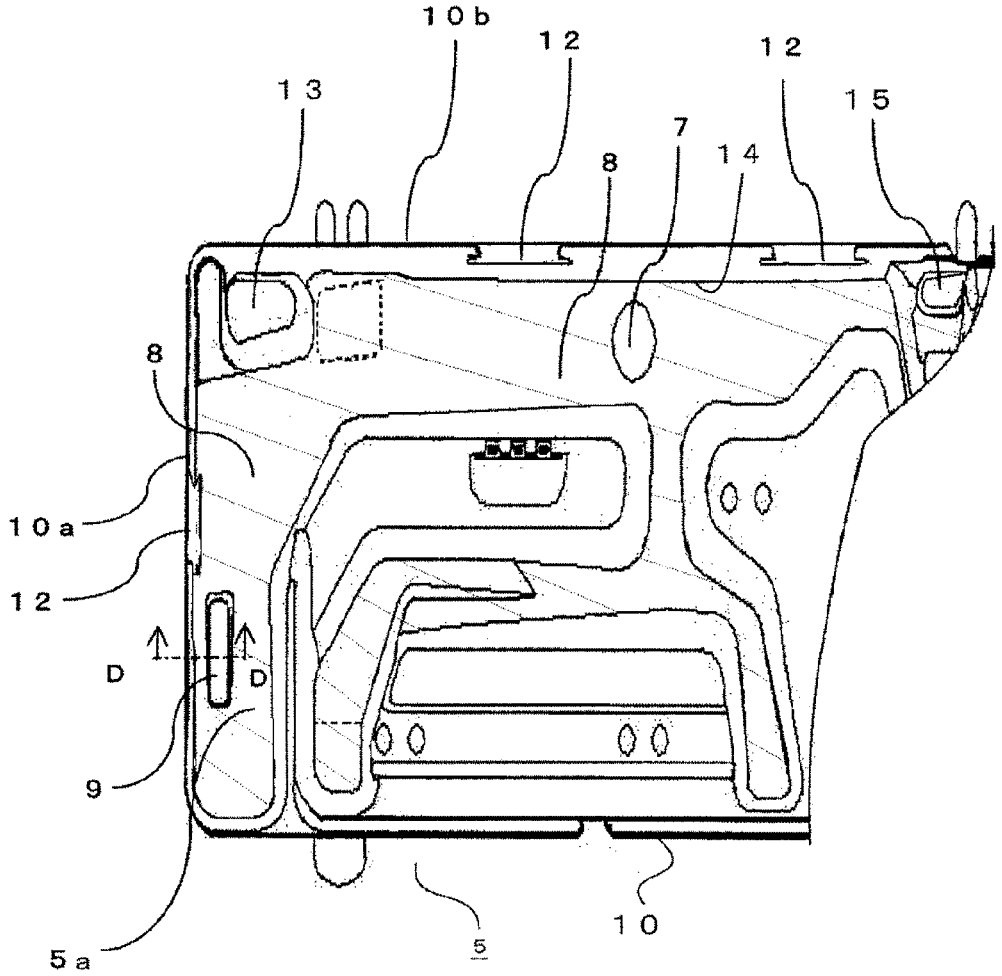
FIG. 13 is a plan view illustrating a bottom plate according to a second embodiment of the present invention.
Figure 14:
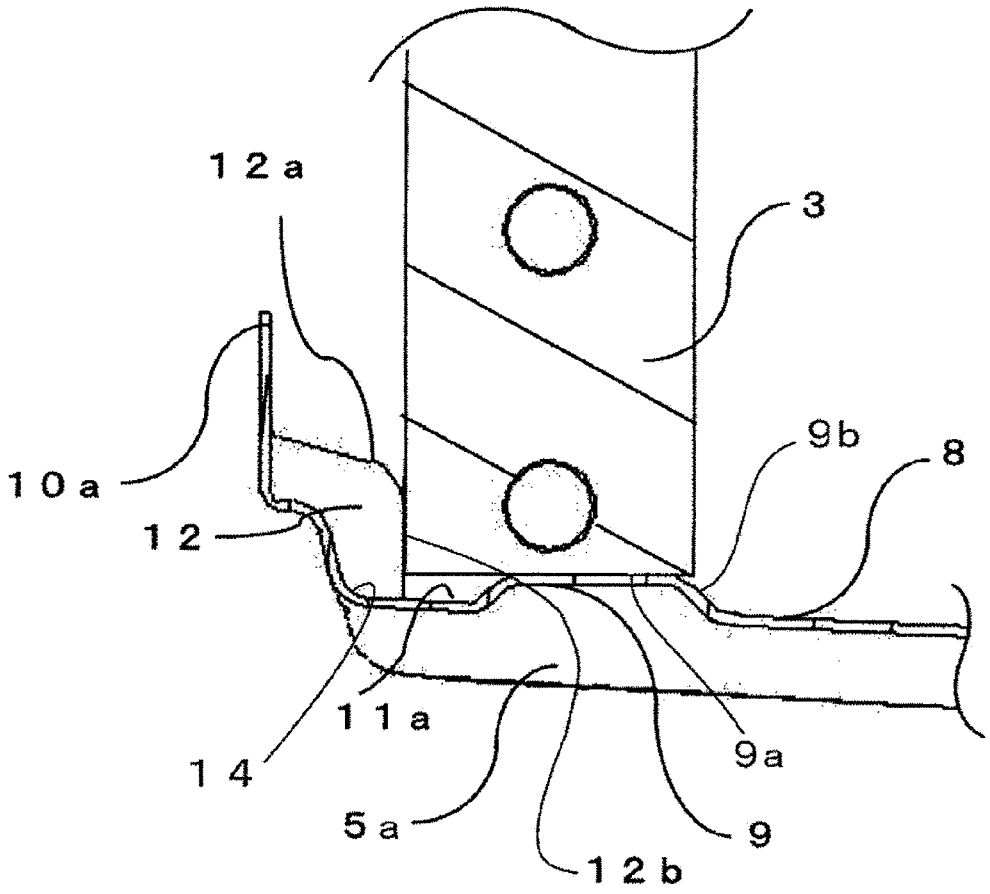
FIG. 14 is a cross-sectional view taken along the line D-D in FIG. 13 to illustrate the bottom plate according to the second embodiment of the present invention.
Figure 15A:
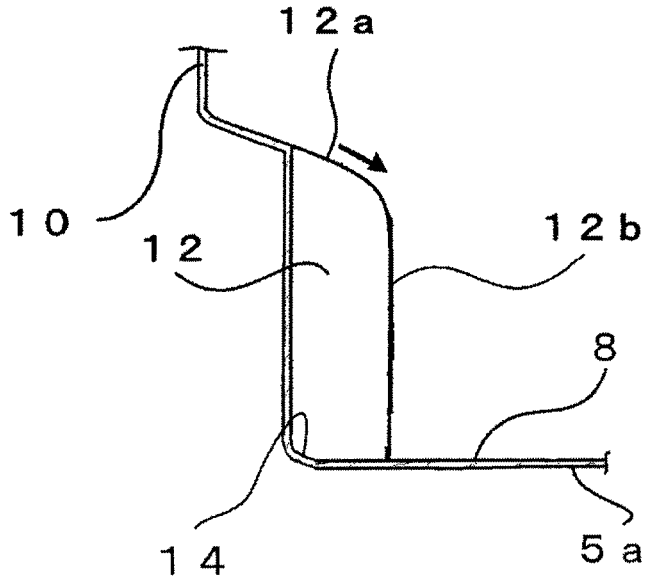
FIGS. 15A and 15B are a side view and a front view illustrating a positioning wall according to the second embodiment of the present invention.
Figure 15B:
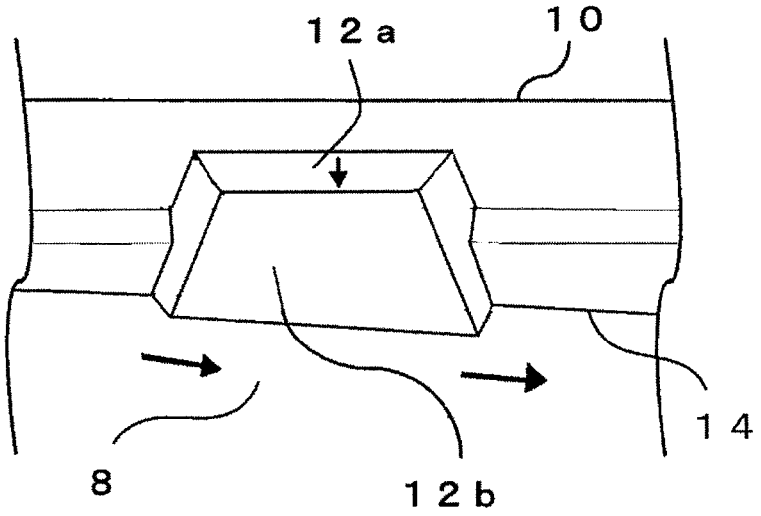

FIG. 13 is a plan view illustrating a bottom plate 5 for housing the heat exchanger 3 and the fan 4. A positioning wall 12 is to determine the installation position of the lateral face of the heat exchanger 3 in the manufacturing process. If the heat exchanger 3 is formed in the L-shape, each of the flanges 10*a* and 10*b* is provided with at least one positioning wall 12. In this embodiment, the flange 10*a* has one positioning wall 12, and the flange 10*b* has two positioning walls 12. Further, FIG. 14 is a cross-sectional view taken along the line D-D in FIG. 13, and the heat exchanger 3 provided on the mounting base 9 is also illustrated. FIGS. 15A and 15B are a side view and a front view illustrating the positioning wall 12. In the drawings, the arrow indicates the direction of the downward inclination.

As illustrated in FIG. 15, the positioning wall 12 has an upper surface 12*a* protruding from an inner side of the flange 10 to the inner side of the housing 1 and extending to the flange 10, and a flat protrusion 12*b* formed in a protruding direction. A lower end of the positioning wall 12 forms a folded-back portion 14 of the flange 10, and is in contact with the drainage groove 8 which is connected to the drainage hole 7.

As illustrated in FIG. 14, the position of the lateral face of the heat exchange 3 is determined by abutting the lateral face of the heat exchanger 3 against the protrusion 12*b*. The lateral face of the flange 10 of the heat exchanger 3 is fixed to the position spaced apart from the flange 10, for example, about 10 mm, by the positioning wall 12. For this reason, even though water drops generated on the surface of the heat exchange tubes 3*a* of the heat exchanger 3 or the fins at the heating operation falls down along the lateral faces of the heat exchanger 3, the water drops drip between the flange 10 and the mounting base 9, so that the water quickly flows to the drainage hole 7 from the drainage groove 8 formed thereto or the inclined portion 11.

The lateral face of the housing 1 is fixed to the outside of the flange 10, but a slight gap is formed between the flange 10 and the housing 1. For example, if the lateral face of the heat exchanger 3 is close to the flange 10, there is a possibility that when the drain water splashes from the end of the fin 3*b*, the water may drip onto the outside of the flange 10. That is, there is a problem in that the drain water is leaked from the lateral face of the housing 1 to the outside of the outdoor. However, with the above configuration, since the lateral face of the heat exchanger 3 is fixed to the position spaced apart from the flange 10 by a predetermined distance by the positioning wall 12, it is possible to prevent the problem in that the drain water is leaked from the lateral face of the housing 1. The distance between the lateral face of the heat exchanger 3 and the flange 10 is not limited to 10 mm. It is only necessary that the distance between the lateral face of the heat exchanger and the flange 10 is set to be longer than the flying distance by estimating, calculating or testing the flying distance of the water drops from the lateral face of the heat exchanger 3.

The upper surface 12*a* of the positioning wall 12 is inclined downward toward the drainage conduit 8, as illustrated in FIG. 15. In this instance, the flange 10*a* side is high, while the side of the positioning wall which abuts against the lateral face of the heat exchanger 3 is low. For this reason, the drain water splashing from the heat exchanger 3 and dripped onto the upper surface 12*a* of the positioning wall 12 flows along the inclination, without being collected on the upper surface 12*a*, and then flows to the drainage hole 7 from the drainage conduit 8 below the heat exchanger 3. Therefore, the drain water is not collected on the upper surface 12*a* of the positioning wall 12 and around the upper surface, so that it is quickly discharged. Accordingly, there is the effect of providing the highly reliable outdoor unit for the air conditioner which can prevent the deformation of the heat exchanger 3 due to the freeze of the drain water.

Figure 16A:
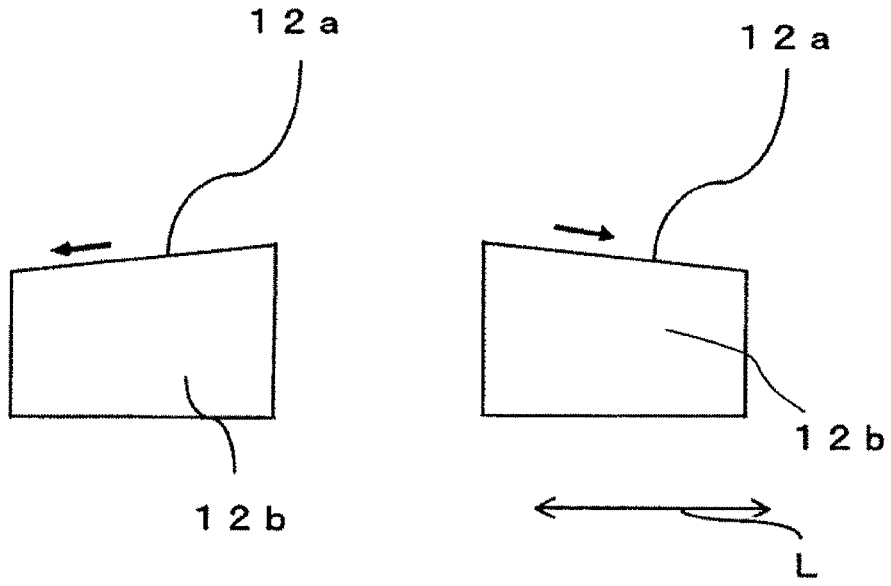
FIGS. 16A and 16B are front views illustrating other shapes of the positioning wall according to the second embodiment of the present invention.
Figure 16B:
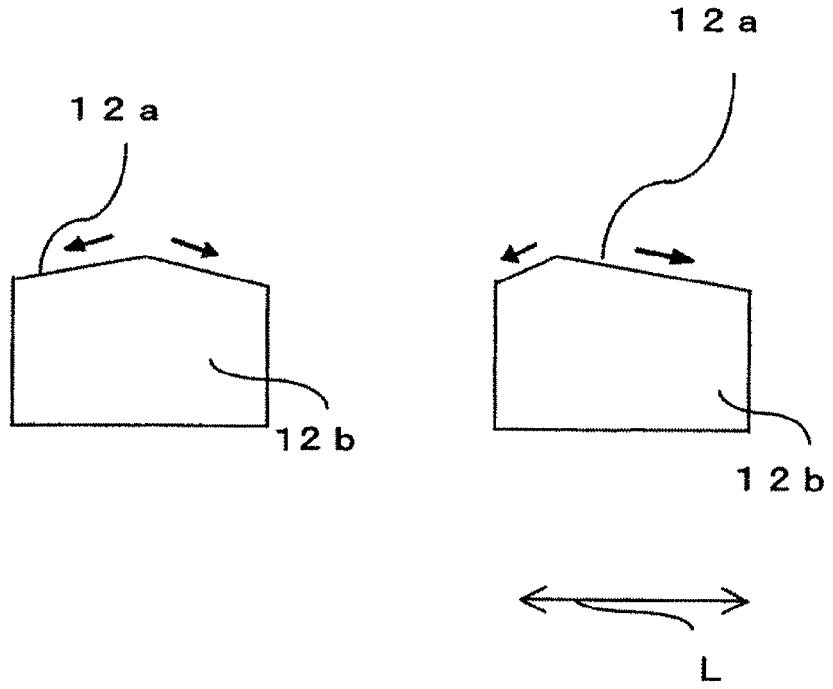

FIGS. 16A and 16B are front views illustrating other shapes of the positioning wall 12. The positioning wall 12 illustrated in FIG. 15 is inclined in the direction perpendicular to the longitudinal direction of the flange 10. The upper surface 12*a* of the positioning wall 12 may be formed in a shape inclined toward the longitudinal direction (direction L) of the flange, as illustrated in FIG. 16A. It is necessary that the inclination direction is toward the direction of the drainage conduit 8 adjacent to the positioning wall 12. For example, the inclination direction need not be the downward direction toward the direction of the drainage hole 7. Even when the inclination inclines upward toward the direction of the drainage hole 7, the dripping onto the upper surface 12*a* drips around the positioning wall 12, and then is finally led to the drainage hole 7 from the drainage conduit 8 or the inclined portion 11. That is, it is only necessary that the upper surface 12*a* of the positioning wall 12 is inclined downward toward the adjacent drainage conduit 8.

The upper surface 12*a* of the positioning wall 12 may be configured by combining two inclinations in an upwardly convex shape, as illustrated in FIG. 16B. The upper surface preferably has a shape such that the drain water dripping onto the upper surface 12*a* flows to the drainage conduit 8 adjacent to the positioning wall 12, without being collected to the upper surface 12*a*. Further, the upper surface 12*a* may be a flat surface or a curved surface of a protruding shape.

In addition, the shape of the protrusion 12*b* of the positioning wall 12 is not limited to that illustrated in FIG. 15. For example, the protrusion 12*b* is need not be a flat surface, but may be a curved surface which is convex in the direction of the heat exchanger 3. However, if the protrusion 12*b* is the flat surface, the lateral face of the heat exchanger 3 can be positioned by the contact with the wide area of the flat surface. Therefore, the position of the heat exchanger 3 can be reliably determined.

As described above, according to this embodiment, there is provided the outdoor unit for the air conditioner, the outdoor unit including: the heat exchanger 3 disposed inside a substantially rectangular parallelepiped housing along the lateral face of the housing 1; and the bottom plate 5 forming the bottom portion of the housing 1, the bottom plate including, the bottom plate portion 5*a*, the flange 10 formed by upwardly folding back the edge of the bottom plate portion 5*a*, the drainage hole 7 penetrating the bottom plate portion 5*a* and configured to discharge the water inside the housing 1 to the outside of the housing 1, the positioning wall 12 including the protrusion 12*b* which protrudes from the flange 10 toward the inner side of the housing 1 and is configured to determine the position of the lateral portion of the heat exchanger 3 by abutting on the lateral portion of the heat exchanger 3, and the drainage conduit 8 provided on the portion of the bottom plate portion 5*a* in contact with the positioning wall 12 and inclining downward toward the drainage hole 7, wherein the upper surface 12*a* of the positioning wall 12 is inclined downward toward the drainage conduit 8. Accordingly, the drain water can be quickly discharged, without being collected on the upper surface 12*a* of the positioning wall 12. Further, the highly reliable outdoor unit for the air conditioner, which can prevent the deformation of the heat exchanger 3 due to the freeze of the drain water, can be provided.

The positioning wall 12 may not be provided in plural. For example, for the I-shaped heat exchanger, the position of the lateral face of the heat exchanger can be determined by one positioning wall 12. Further, the positioning wall 12 is usually formed integrally with the bottom plate 5 by press molding, but the present invention is not limited thereto. The positioning wall 12 may be fixed to the flange 10 as a separate member.

The present invention provides illustrative, non-limiting examples as follows:

(1) In a first aspect, there is provided an outdoor unit for an air conditioner, the outdoor unit including: a heat exchanger disposed inside a substantially rectangular parallelepiped housing along a lateral face of the housing; and a bottom plate forming a bottom portion of the housing, the bottom plate including, a bottom plate portion, a flange formed by upwardly folding back an edge of the bottom plate portion, a drainage hole penetrating the bottom plate portion and configured to discharge water inside the housing to an outside of the housing, a plurality of mounting bases provided on the bottom plate portion, protruding upwardly from the bottom plate portion at positions spaced apart from the flange by a predetermined distance, and supporting a lower end of the heat exchanger by upper surfaces thereof, and a drainage conduit provided in contact with the mounting bases and inclining downward toward the drainage hole, wherein a portion of the bottom plate portion positioned between at least one of the plurality of the mounting bases and the flange includes an inclined portion which is inclined toward the drainage conduit in a longitudinal direction of the flange.

(2) In a second aspect, there is provided the outdoor unit for the air conditioner according to the first aspect, wherein the inclined portion is inclined downward toward the drainage conduit from a position which is lower than the upper surface of the mounting base and is higher than the drainage conduit.

(3) In a third aspect, there is provided the outdoor unit for the air conditioner according to the first or second aspect, wherein both ends of the heat exchanger in a width direction thereof protrude outward from the upper surface of the mounting base.

(4) In a fourth aspect, there is provided the outdoor unit for the air conditioner according to the first aspect, wherein portions of the bottom plate portion positioned between each of the plurality of the mounting bases and the flange respectively include the inclined portion which is inclined toward the drainage conduit in the longitudinal direction of the flange.

(5) In a fifth aspect, there is provided an outdoor unit for an air conditioner, the outdoor unit including: a heat exchanger disposed inside a substantially rectangular parallelepiped housing along a lateral face of the housing; and a bottom plate forming a bottom portion of the housing, the bottom plate including, a bottom plate portion, a flange formed by upwardly folding back an edge of the bottom plate portion, a drainage hole penetrating the bottom plate portion and configured to discharge water inside the housing to an outside of the housing, a positioning wall including a protrusion portion which protrudes from the flange toward an inner side of the housing and is configured to determine a position of a lateral portion of the heat exchanger by abutting on the lateral portion of the heat exchanger, and a drainage conduit provided on a portion of the bottom plate portion in contact with the positioning wall and inclining downward toward the drainage hole, wherein an upper surface of the positioning wall is inclined downward toward the drainage conduit.

What is claimed is:

1. An outdoor unit for an air conditioner, the outdoor unit comprising:

a heat exchanger disposed inside a substantially rectangular parallelepiped housing along a lateral face of the housing; and a bottom plate forming a bottom portion of the housing, the bottom plate including, a bottom plate portion, a flange formed by upwardly folding back an edge of the bottom plate portion, a drainage hole penetrating the bottom plate portion and configured to discharge water inside the housing to an outside of the housing, a plurality of mounting bases provided on the bottom plate portion, protruding upwardly from the bottom plate portion at positions spaced apart from the flange by a predetermined distance, and supporting a lower end of the heat exchanger by upper surfaces thereof, and a drainage conduit provided in contact with the mounting bases and inclining downward toward the drainage hole, wherein a portion of the bottom plate portion positioned between at least one of the plurality of the mounting bases and the flange includes an inclined portion which is inclined toward the drainage conduit in a longitudinal direction of the flange, wherein the longitudinal direction is parallel to the edge of the bottom plate where the inclined portion is provided.

2. The outdoor unit for the air conditioner according to claim 1, wherein the inclined portion is inclined downward toward the drainage conduit from a position which is lower than the upper surface of the mounting base and is higher than the drainage conduit.

3. The outdoor unit for the air conditioner according to claim 1, wherein both ends of the heat exchanger in a width direction thereof protrude outward from the upper surface of the mounting base.

4. The outdoor unit for the air conditioner according to claim 1, wherein portions of the bottom plate portion positioned between each of the plurality of the mounting bases and the flange respectively include the inclined portion which is inclined toward the drainage conduit in the longitudinal direction of the flange.

5. The outdoor unit for the air conditioner according to claim 1, wherein the bottom plate further comprises:

a positioning wall being integrated with the bottom plate, including a protrusion portion which protrudes from the flange toward an inner side of the housing and an upper surface that declines toward the drainage hole, and being configured to determine a position of a lateral portion of the heat exchanger by abutting on the lateral portion of the heat exchanger, and wherein an upper surface of the positioning wall is inclined downward toward the drainage conduit.

6. The outdoor unit for the air conditioner according to claim 1, wherein each of the upper surfaces of the plurality of mounting bases has a width that is equal to or smaller than a lower end of the heat exchanger, and each of the plurality of mounting bases has an inclined portion and a lateral face that both decline toward the drainage conduit.

7. The outdoor unit for the air conditioner according to claim 5, further comprising a plurality of mounting bases extending from the bottom plate portion, each of the plurality of mounting bases has an upper surface width that is equal to or smaller than a lower end of the heat exchanger, an inclined portion, and a lateral face, the inclined portion and the lateral face both decline toward the drainage conduit.

8. The outdoor unit for the air conditioner according to claim 1, wherein the drainage conduit includes a plurality of linear drainage paths, each of the plurality of linear drainage paths decline in different directions that lead toward the drainage hole.

9. The outdoor unit for the air conditioner according to claim 5, wherein the drainage conduit includes a plurality of linear drainage paths, each of the plurality of linear drainage paths decline in different directions that lead toward the drainage hole.

10. The outdoor unit for the air conditioner according to claim 8, wherein the plurality of linear drainage paths are irregularly shaped.

11. The outdoor unit for the air conditioner according to claim 9, wherein the plurality of linear drainage paths are irregularly shaped.

12. The outdoor unit for the air conditioner according to claim 1, wherein the inclined portion of the flange is inclined toward the drainage conduit in the longitudinal direction of the flange that is closest to the inclined portion.

13. The outdoor unit for the air conditioner according to claim 1, wherein the inclined portion is inclined from a non-flat top toward the drainage conduit.

14. The outdoor unit for the air conditioner according to claim 1, wherein the portion of the bottom plate portion positioned between the at least one of the plurality of the mounting bases and the flange that includes an inclined portion is positioned between the at least one of the mounting bases and a portion of the flange parallel to the direction of incline of the inclined portion.

* * * * *